United States Patent [19]

Wolf

[11] Patent Number: 4,607,754

[45] Date of Patent: Aug. 26, 1986

[54] MERCHANDISING DISPLAY SYSTEM AND METHOD

[76] Inventor: Morris A. Wolf, 7048 Macapa Dr., Los Angeles, Calif. 90068

[21] Appl. No.: 496,260

[22] Filed: May 19, 1983

[51] Int. Cl.[4] ..... A47F 5/00

[52] U.S. Cl. ..... 211/183; 211/189; 29/155 R; 29/469.5

[58] Field of Search ..... 211/183, 189, 191, 192, 211/208; 52/127.1, 390, 391, 588, 731; 72/46; 29/155 R, 155 C, 469.5

[56] References Cited

U.S. PATENT DOCUMENTS

| | | | |
|---|---|---|---|
| 987,693 | 3/1911 | von Borries | 29/155 R |
| 3,077,059 | 2/1963 | Stout | 52/127.1 X |
| 3,327,870 | 6/1967 | Fairchild, Jr. | 211/183 |
| 3,524,292 | 8/1970 | Bottom | 52/588 X |
| 4,069,638 | 1/1978 | Hasselqvist et al. | 403/302 X |
| 4,133,433 | 1/1979 | Wolf | 211/192 |

FOREIGN PATENT DOCUMENTS

| | | | |
|---|---|---|---|
| 53318 | 3/1982 | Japan | 29/469.5 |
| 759529 | 10/1956 | United Kingdom | 29/155 R |
| 2044079 | 10/1980 | United Kingdom | 211/192 |

*Primary Examiner*—J. Franklin Foss
*Assistant Examiner*—Blair Johnson
*Attorney, Agent, or Firm*—Fulwider, Patton, Rieber, Lee & Utecht

[57] ABSTRACT

A merchandising display system and the method of making its posts and struts, using pre-decorated strip material having surfaces such as polished metal or wood-grained vinyl that are covered by removable protective strips. A plurality of elongated sections of the strip material are bent longitudinally to form side portions of the desired cross-sectional shape, including overlapping portions defining longitudinal grooves, and are secured together by rivets in the grooves. The protective strips are slit in the grooves for quick and neat removal.

The grooves in the posts have slots for receiving tabs of tightening mechanisms in the ends of the struts, each including a base plate that is movable longitudinally of the strut by a screw mechanism. Different embodiments are shown for the base plates and the guiding of the base plates for sliding on the struts.

14 Claims, 15 Drawing Figures

MERCHANDISING DISPLAY SYSTEM AND METHOD

BACKGROUND OF THE INVENTION

This invention relates to structures and frameworks, and has particular reference to the construction of display systems for use in the merchandising field, that is, structures and frameworks that serve as artistic and decorative supports and backgrounds for merchandise that is on sale in establishments of various kinds, for example, department stores and the like.

In the past, systems of a number of kinds have been available to the merchandiser, to provide shelves, racks, hangers, brackets, hangrails and other facilities upon which merchandise can be displayed. While permanent installations sometimes were used for these purposes, the changing needs of merchandisers made it desirable to be able to change and rearrange displays with relative ease and economy.

One display system that satisfied this need for flexibility and versatility is shown in U.S. Pat. No. 4,133,433, and utilizes as its principal elements extruded aluminum posts having longitudinal grooves in their sidewalls, with mounting slots in the bottom walls of the grooves, and elongated, board-like struts also made of extruded aluminum pieces and having mounting brackets in their ends that are engageable in the slots of the posts and tightenable to fasten the posts and the struts securely but releasably together. Although the extruded parts, by themselves, were not particularly attractive, that patented display system provided for the covering of the posts and struts with decorative sheet material, such as fabric, wood veneer, sheet vinyls and wallpaper, applied in strips and cemented in place. The exposed aluminum, along the slots, was dark anodized so as to be relatively inconspicuous.

While that patented display system was adequate for its intended purposes, it was quite expensive, considering the cost of aluminum extrusions and, in addition, the cost of labor and materials necessary to decorate the extruded parts to make them attractive. In addition, it was relatively bulky and had limitations with respect to the ability to provide polished metallic decorative surfaces.

This invention is an improvement in the type of display system that is described in that patent, and is usable in substantially the same way that is described in that patent, the disclosure of which is incorporated herein by reference to avoid the necessity of repeating that disclosure here. The improved display system of this invention is substantially less expensive than the system disclosed in the patent—in fact, the posts and struts of the present invention presently cost less per linear foot in their highly attractive decorated condition than the cost of the undecorated extruded parts of the prior system. Moreover, brightly polished metallic decorative surfaces are available, as well as other decorative surfaces.

SUMMARY OF THE INVENTION

The present invention resides in a method of making structural members for display systems, and the members so made, in which each member is formed by joining together a plurality of elongated strips which constitute longitudinal sections of the member, thereby eliminating the need to use extruded parts to produce the structural members, and predecorated, mass-produced strip material is used to form the strips, thereby eliminating the need for later decorating operations. Stock, mass-produced metal strip material is commercially available with a wide variety of decorative surfaces, and is supplied with a protective masking material that covers and protects the decorative surfaces during fabrication and handling, and can be peeled off when the member has been assembled and is ready for use.

Using such strip material with protected predecorated surfaces, the method of the invention comprises the steps of bending elongated sections of the strip material longitudinally so that a plurality of the sections will fit together to form the structural member, and providing overlapping edge portions on the sections to be joined together and preferably to define longitudinal grooves in the finished member as well; fitting the sections together; and securing the overlapping portions together, for example, with rivets concealed in the longitudinal grooves. After the fabricating operations are complete, the protective strips can be removed, fast and neat removal being facilitated by slits in the portions of the protective strips that are inside the longitudinal grooves.

The preferred post is formed by four corner strips that have the same configuration, including a right-angle central portion bounded on one side by a U-shaped channel and on the other side by an L-shaped bend for overlapping and interfitting with the channel of an adjacent strip. The channels and the L-shaped bends define the longitudinal grooves and form double-thickness walls at the bottoms of the grooves, which constitute the load-carrying elements of the posts.

The preferred strut comprises two strips, each of which is shaped to form a substantially flat and relatively wide side, two relatively narrow side sections that are joined to each wide side at an angle of ninety degrees, and two L-shaped bends projecting first inwardly parallel to the wide side and then laterally away from the wide sides. When the strips are fitted together, the free edge portions overlap, and the narrow side sections form two narrow sides each having a central longitudinal groove. The mounting brackets and tightening mechanisms are similar to those in the prior patent, with detailed improvements in their structure and mounting.

Other aspects and advantages of the invention will become apparent from the following detailed description taken in conjunction with the accompanying drawings.

DETAILED DESCRIPTION

Figure 1:
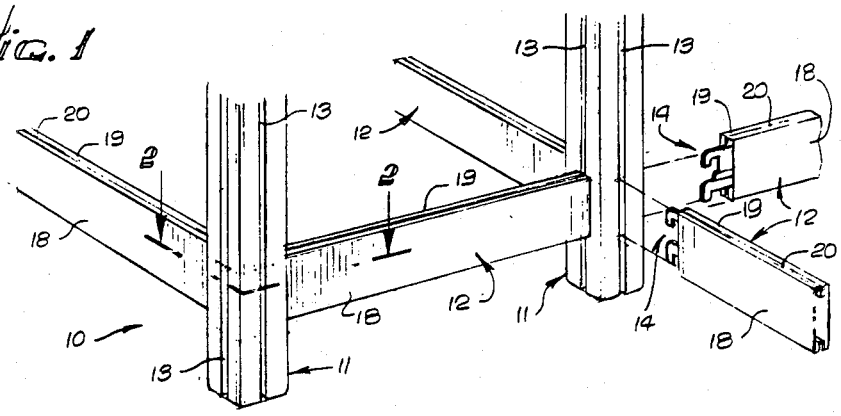
FIG. 1 is a fragmentary perspective view of a portion of a merchandising display system in accordance with the present invention, with two struts shown in detached but aligned positions.
Figure 2:
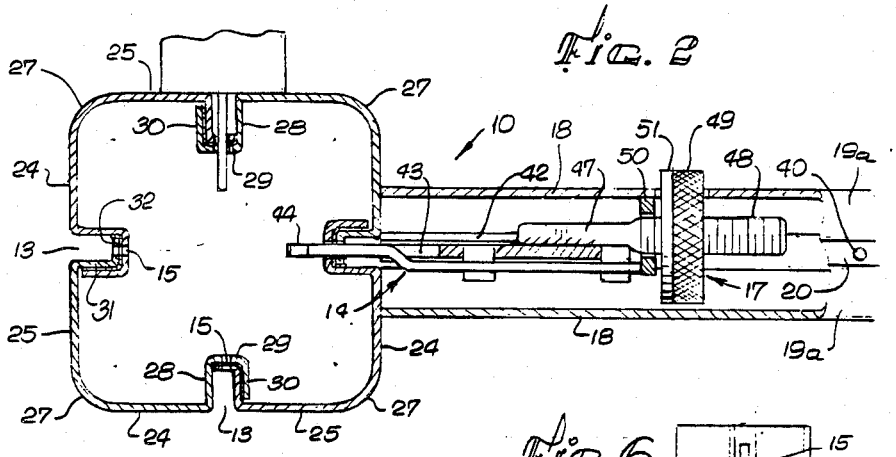
FIG. 2 is an enlarged fragmentary cross-sectional view taken substantially along line 2—2 of FIG. 1.

As shown in the drawings for purposes of illustration, the invention is embodied in a merchandising display system or structure, indicated generally by the reference number 10, of the type comprising upright posts 11 and horizontal struts 12 which are secured to the posts in longitudinal grooves 13 for receiving mounting brackets 14 on the ends of the struts. These mounting brackets engage in slots 15 in the grooves and are tightened by screw mechanisms 17 in the struts, thereby to join the posts and the struts securely together in a preselected arrangement.

Broadly, the illustrative merchandising display system 10 is of the same type as the system that is disclosed in the aforesaid patent, and is usable in the same way. Posts 11 and struts 12 are provided in selected lengths and numbers, with accessory items (not shown) that are appropriate for a particular plan and design, sometimes including shelves, panels, brackets and other readily available items and materials, and are assembled in accordance with the plan and design.

For present purposes, it should be sufficient to show only the posts 11 and struts 12, where the improvements of this invention are found, and to refer to the prior patent for background details that need not be repeated here. In FIG. 1, it can be seen that the posts 11 typically are used in upright positions, and the struts 12 typically are horizontal, and are engageable with a post in any of the four longitudinal grooves 13 that are formed in the four sides of each post. The posts shown herein are of the preferred shape—substantially square in cross-section, and the struts 12 also are shown in the preferred substantially rectangular cross-sectional shape. Each strut has two flat and relatively wide laterally facing sides 18 and two relatively narrow upper and lower sides 19 which are formed with grooves 20 that may be used to receive panels and the like. Both the posts 11 and the struts 12 may be supplied in several standard sizes for use in different situations.

Figure 3:
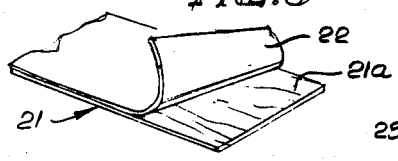
FIG. 3 is an enlarged fragmentary view of a representative piece of strip material used in the present invention, shown with an end portion of a protective strip peeled partially away from the decorative surface both to illustrate separability and to show the decorative surface of the trip material that is provided.

An important aspect of the present invention is the use of pre-decorated mass-produced strip material 21, a representative piece of which is shown in FIG. 3, as the starting material from which both posts 11 and struts 12 can be made, with very substantial savings as compared to the extruded aluminum pieces that were the recommended materials in the aforesaid patent. The decoration desired can be selected from a variety of different available decorative surfaces, including metallic surfaces such as brushed brass and chrome, and non-metallic surfaces such as wood-grain vinyl or simulated leather, all of the highest quality available through mass-production techniques and at relatively low prices.

Such strip material is provided in appropriate widths to form post and strut sections of the desired sizes and shapes, and with the selected decorative surfaces **21*a* covered by protective strips 22 that prevent damage to the surfaces during handling and fabrication. The strips are bent longitudinally to the desired shape, preferably using conventional roll-forming techniques, with the protective strips 22 still in place, and then are fitted and fastened together to make up the posts 11 and the struts 12**.

Figure 4:
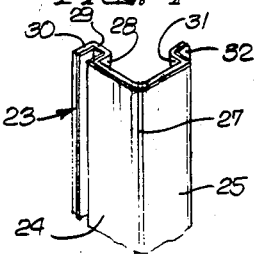
FIG. 4 is a fragmentary perspective view of one end portion of one of the four corner sections used to form the illustrative post, shown on a reduced scale relative to FIG. 2 and illustrating the step of bending the strip material.
Figure 5:
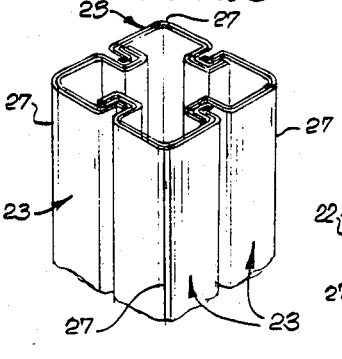
FIG. 5 is a fragmentary perspective view showing four corner sections of the type in FIG. 4, illustrating the step of fitting the sections together in the form of a post.

More specifically, the preferred posts 11 are formed by four substantially identical corner sections 23, as shown in FIGS. 4 and 5, each composed of one elongated piece of strip material 21 that is bent longitudinally to form a central portion having two substantially equal sides 24 and 25 that are joined by a rounded ninety-degree bend 27. A U-shaped channel is formed along one edge of the corner section by an inwardly extending sidewall 28, a bottom wall 29 in a plane parallel to the side section 25, and a free edge portion 30 forming the second sidewall of the channel, terminating short of the plane of the side section 24. An L-shaped bend extends along the other edge of the corner section, having a narrow inwardly extending portion 31 and a free edge portion 32 that is parallel to the side section 25. This free edge portion constitutes a "foot" that fits into the channel of an adjacent and overlapping corner section 23 and abuts against the bottom wall 29 thereof, for use in joining the corner sections of the post 11 together.

Figure 6:
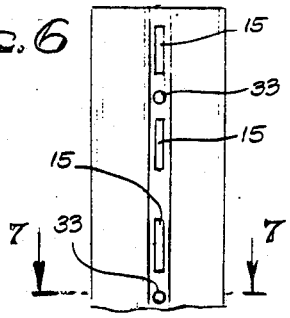
FIG. 6 is a fragmentary side elevational view of the post, and illustrating the formation of fastener holes and mounting slots in the corner sections.
Figure 7:
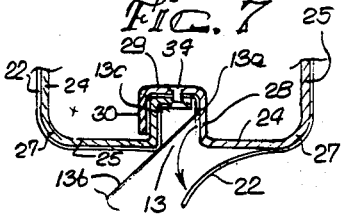
FIG. 7 is a fragmentary cross-sectional view, on an enlarged scale, taken along line 7—7 of FIG. 6, and illustrating the riveting of the corner sections and the formation of weakened lines in the protective strips by cutting, for quick and neat removal.

Four such corner sections 23 of equal length are interfitted in the manner shown in FIG. 5 and joined together by fastening means which preferably act between the feet 32 and the bottom walls 29. Herein, a series of holes 33 (FIG. 6) is punched through these walls in each of the four grooves 13 defined in the sides of the post, and rivets 34 (FIG. 7) are seated in these holes. It is to be noted in FIGS. 5 and 7 that the protective strips 22 may remain in place at this stage, to protect the decorative surfaces **21*a*** during the fabrication operations and also during subsequent handling.

The means for fastening other elements to the posts 11 is substantially the same in this case as in the aforesaid patent, the mounting slots 15 that are provided in the grooves for engagement with the brackets 14 on the struts 12. These slots may be punched during the same operation in which the rivet holes 33 are formed, and extend through both the feet 32 and the bottom walls 29 of the channels.

With this arrangement, it will be seen that the principal load-carrying elements of the posts 11 are double-walled elements, which makes possible the use of thinner and lighter strip material 21. One suitable material is 22 guage pre-plated steel, having a thickness on the order of 0.030 of an inch. This type of material is supplied in rolls of strip material of a selected width, the presently preferred widths for the present invention being three and one-half inches for the post strips and five and one-half inches for the strut strips. These dimensions are only illustrative, however, as the system can be made in any desired size. One source of this type of material is American Nickeloid Company, Los Angeles, Calif. When the post 11 is assembled with the protective strips 22 remaining in place, as is the preferred method because of the importance of protecting the decorative surfaces of the sections, it will be apparent that parts of the protective strips will be trapped between the overlapping portions of the sections that are riveted together. While this could be avoided by removing at least these parts of the protective strips, in advance of riveting, there is no need to do so.

Instead, the protective strips may be left entirely in place, so that the rivet holes 33 and the slots 15 extend through the strips, and means are provided for allowing quick and neat separation of the trapped portions of the strips from the free portions of the strips. Herein, these means comprise at least one weakening line in each of the grooves 13, such as a slit **13*a* (FIG. 7) formed by a blade 13*b* drawn along the sidewall of the exposed channel. While the protective strip on the foot 32 may be pulled off the rivets without difficulty, removal of this strip can be facilitated by making a second slit 13*c* along the wall 31**.

Protective strips and their manner of attachment are conventional, and are part of the strip material that may be purchased for use in the invention. Their composition may be paper or a plastic coating, either of which adheres to the decorative surface and can be peeled off to expose the surface at the appropriate time. Preferably, this is when all danger of marring is past, and may be a step during the process of installing a display system in a place of business.

Figure 8:
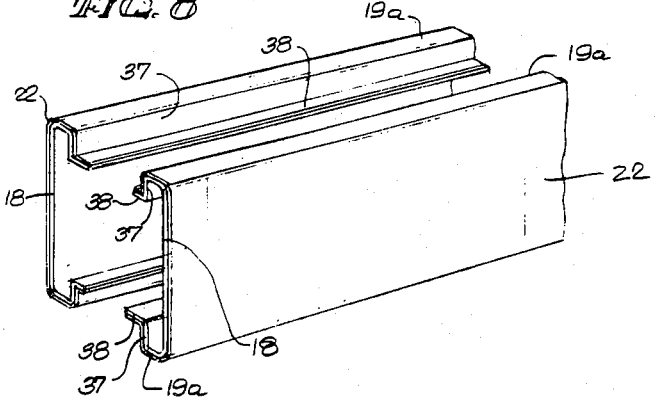
FIG. 8 is a fragmentary perspective view of two strips after bending to the shape for use in forming a strut.
Figure 11:
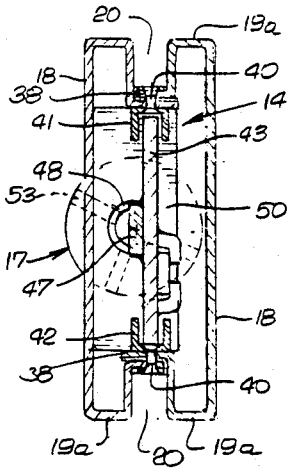
FIG. 11 is a cross-sectional view taken substantially along line 11—11 of FIG. 10.

The configuration of the strut strips, after the bending step, is shown in FIG. 8, and includes for each strip a relatively wide sidewall 18 having a narrow sidewall section **19*a* joined to it along each side at a ninety-degree angle, another narrow, inwardly-extending wall 37 parallel to the sidewall 18, and an in-turned free edge portion 38 for overlapping the mating free edge portion of the other strip. As can be seen in FIG. 11, the two free edge portions on each strip are of slightly different dimensions, to dispose the sidewall sections 19*a* at each narrow side 19 in the same plane, on opposite sides of the groove 20** defined in each of the narrow sidewall sections.

Figure 9:
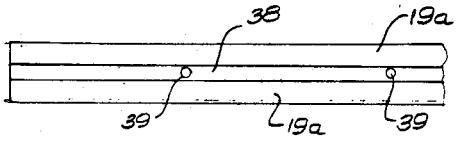
FIG. 9 is a fragmentary top plan view showing the two strut strips titted together and formed with rivet holes.

To join the two strut strips together, a series of rivet holes 39 (FIG. 9) is formed in each pair of overlapping free edge portions 38, and rivets 40 (FIGS. 10 and 11) are set in these holes and clamp the free edge portions tightly together. The mounting brackets 14 are supported in the ends of the struts 12 between the bottom walls 38 of the grooves 20, herein in tracks 41 and 42 (FIGS. 10 and 11) that are held in place by the two rivets 40 nearest the end of the strut, as shown in FIG. 10.

More specifically, each mounting bracket 14 comprises a generally rectangular base plate 43 having two latching elements 44 in the form of tabs on one of its edges, extending outwardly for insertion into one of the grooves 13 in a post 11 and into two of the slots 15 therein, the spacing of the slots and the tabs being the same. A notch 45 in the underside of each tab is sized to fit loosely over the double-thickness bottom wall of the groove to latch the bracket to the post, loosely, before tightening by the tightening mechanism 17.

Figure 10:
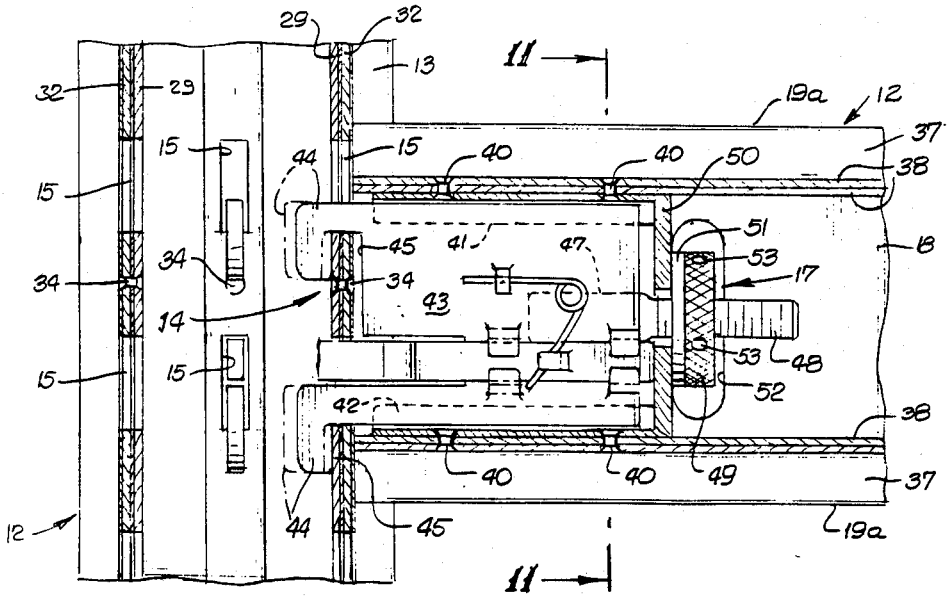
FIG. 10 is an enlarged fragmentary cross-sectional view, on an enlarged scale, taken substantially along line 10—10 of FIG. 2.
Figure 12:
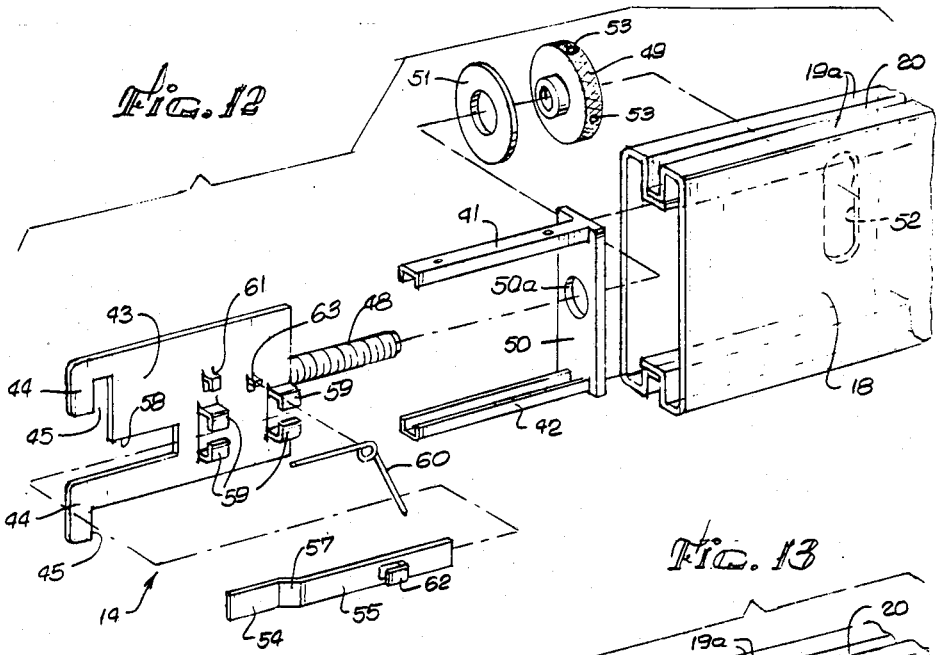
FIG. 12 is an exploded perspective view of part of FIG. 10.

The tightening mechanism 17 is a simple screw mechanism that is built into the end portion of the strut 12 to pull the bracket 14 inwardly from an extended position, indicated in broken lines in FIG. 10, to a retracted position, shown in full lines, in one direction of rotation of the screw mechanism, and to move the bracket reversely in the other direction of screw rotation. Each screw mechanism has an elongated stud having a flattened end portion 47 that is disposed against one side of the base plate and secured thereto, for example by welding, and a threaded end portion 48 which extends inwardly from the base plate 43 and through a cylindrical nut 49. The nut is rotatably supported in the strut, but is held against axial movement by a mounting member 50 (FIG. 11) in the strut, this member herein being a crosspiece between the inner ends of the two tracks 41 and 42 and separated from the nut by a washer 51, with the threaded end portion 48 of the stud passing through a clearance hole **50*a*** in the crosspiece.

With this arrangement, rotation of the nut 49 shifts the threaded end 48 axially through the nut, longitudinally of the strut, to move the associated mounting bracket 14 in a selected direction. The nut is offset slightly from the center of the strut, and has a large enough radius to project into, and preferably through, a slot 52 in one side of the strut, and the periphery of the nut is knurled to facilitate manual turning. In addition, radial bores 53 are provided in the nut to receive a tool (not shown) in the form of a nail or other simple rod, for tightening and loosening of the screw mechanism.

For positive locking of the struts 12 on the posts 11, a special locking plunger 54 is incorporated in the screw mechanism 17 to be inserted into one of the slots 15 alongside one of the tabs 44, as an incident to the tightening of the mounting bracket 14. The plunger is an elongated bar, preferably composed of material that is of the same thickness as the base plate 43, and has an inner end portion 55 that is disposed alongside the base plate, and an outer end portion 54 that is offset, at a bend 57, into an elongated notch 58 in the outer portion of the base plate, opening out of the base plate in line with one side of one of the tabs 44, the side opposite the notch 45 in the tab.

Two pairs of fingers 59 are punched out of the inner portion of the base plate 43 and bent outwardly to form retainers for the plunger 54, 55, in line with the notch 58, and the inner end portion 55 of the plunger is slidably held between these fingers. The length of the plunger is approximately the same as the longitudinal distance from the inner edge of the base plate to the outer ends of the tabs 44, and in the retracted position, the inner end portion 55 projects inwardly well beyond the edge.

The plunger 54, 55 is urged yieldably toward the retracted position by means of a spring 60 acting between an anchor 61 on the base plate and an anchor 62 on the plunger, the anchors herein being small tabs that are punched out of the two parts, and the spring being a length of spring wire having a central portion that is coiled around a stud 63 on the base plate. Opposite end portions of the spring are stressed and confined against the anchor tabs 60 and 61.

As shown in FIG. 10, the inner end portion 55 of the plunger is held by the spring 60 against the crosspiece 50. This effectively fixes the position of the plunger relative to the strut 12, while the plunger remains movable relative to the base plate 43, between the retracted and extended positions shown in broken lines and full lines in FIG. 10.

Thus, as the mounting bracket 14 is drawn into the strut 12, the plunger 54, 55 is restrained by the crosspiece 50 against moving inwardly with the bracket. As the tabs 44 are drawn inwardly and the strut 12 is pulled closer to the post 11, the plunger is extended relative to the tabs for insertion into the slot 15 in which the adjacent tab is engaged. When this tab is in the engaged position shown in FIG. 10, the plunger enters the slot alongside the tab, and thereafter blocks movement of the tab longitudinally of the groove to any position in which the tab can be pulled out of the slot, even if the screw mechanism should become loosened to some extent. Of course, when the screw mechanism is turned reversely to the extent necessary to draw the plunger out of the slot, the tabs can be readily disengaged for separation of the strut from the post.

Figure 13:
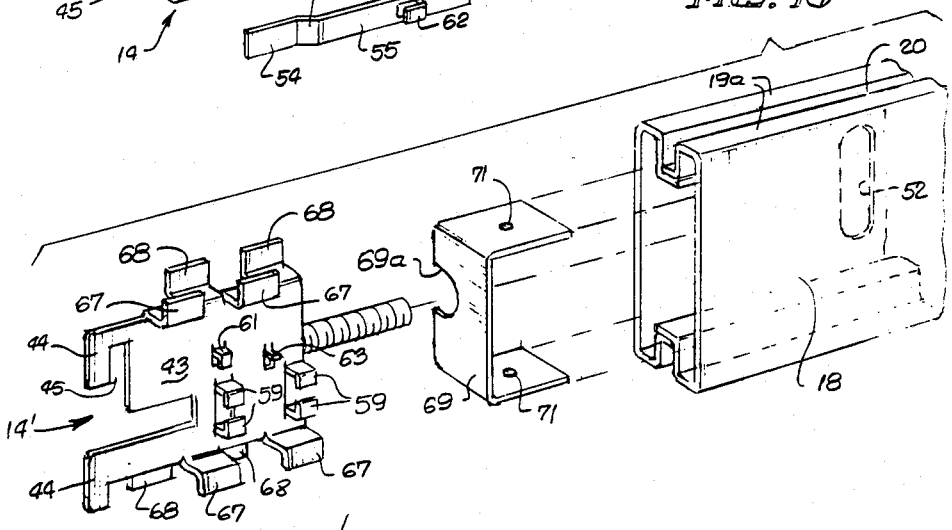
FIG. 13 is a view similar to part of FIG. 12 but showing an alternative embodiment.
Figure 14:
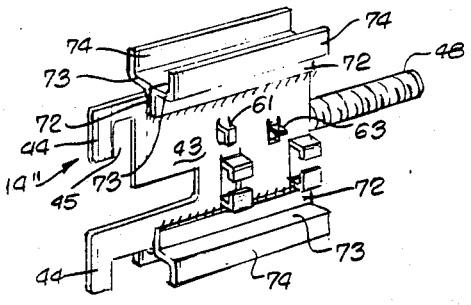
FIG. 14 is a view similar to part of FIG. 13 but showing anothwer alternative embodiment.
Figure 15:
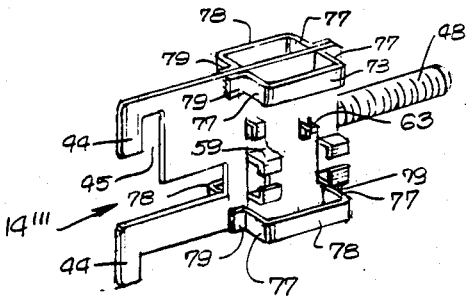
FIG. 15 is a view similar to FIG. 14 but showing another alternative embodiment.

Shown in FIGS. 13, 14 and 15 are three alternative embodiments of the mounting bracket 14 illustrating different ways of mounting the bracket 14 (denominated 14', 14'' and 14''' in the alternative embodiments) in the strut 12. In each of these alternatives, the basic structure is the same, and corresponding parts are indicated by the same reference numbers. The differences reside in the manner of mounting the base plate 43 in the strut 12.

As shown in FIG. 13, the tracks 41 and 42, and the crosspiece 50, are replaced by two series of oppositely offset alternating tabs 67 and 68 that are formed integrally with the base plate 43, along its upper and lower edges, to straddle guiding ridges in the strut 12, that are formed by the inner sides of elements of the strut forming the grooves 20. These tabs are initially coplanar with the base plate, when it is stamped out or otherwise manufactured, and then are bent out of the plane of the base plate and offset therefrom, and also are bent to the "L" shape shown in FIG. 13.

Preferably, two tabs 67 are spaced apart along one side of each of the upper and lower edges, and two tabs 68 are spaced apart along the edges on the other side. These tabs form, in effect, a guide groove fitting around the guiding ridges inside the strut, and thus support the bracket 14' for movement relative to the strut. A U-shaped bracket 69, with a clearance hole **69*a* for the stud 48, is secured in place in the position of the crosspiece 50, by two of the rivets 40 in rivet holes 71, to serve as an abutment for the plunger 54, 55**.

In FIG. 14, the bracket 14'' has guide grooves that are defined by two elongated troughs along the upper and lower edges of the base plate 43, each trough being defined by two generally Z-shaped pieces, preferably of sheet metal, each having a wall 72 that is fastened, as by welding, to the base plate, an offset wall 73, and an upstanding wall 74 constituting the side of the trough. On the lower edge, identical pieces are welded to the base plate with the walls 74 extending downwardly.

In FIG. 15, the bracket 14''' is designed to be guided in the strut by four guides which engage both the guiding ridges above and below the bracket and the sidewalls 18 of the strut. Each of these guides herein is a relatively narrow metal strip having a U-shaped central portion comprising two legs 77 and a crosspiece 78, and two mounting tabs 79 that project in opposite directions from the legs.

The tabs 79 are secured, as by welding, to the base plate 43 to join two of the guides to opposite sides of the base plate with their upper edges extending along the plate's upper edge, and the other two guides are similarly joined to the plate along the lower edge. Through these guides, the bracket is sized to slide freely along and be guided between the guiding ridges above and below the bracket and the two sidewalls on opposite sides, the effective height and width of the bracket being determined by the guides.

In each alternative, a U-shaped bracket 69 is provided as an abutment, and the tightening mechanism operates in the same manner as in the first embodiment. The alternative embodiments merely eliminate the need for the tracks 41 and 42 by providing guiding means on the base plate 43.

From the foregoing, it will be seen that the present invention constitutes a significant improvement over the aforesaid patent, principally because of the substantial cost reduction achieved by bending predecorated strip material to form longitudinal sections of the parts and then joining them together. It also is important to note, however, that the predecorated strip material may be thinner and lighter than the aluminum previously used, and less bulky, and that the available surfaces are generally superior to those that could be provided on the aluminum extrusions. Most important of all, however, is the cost reduction that can be achieved.

It also will be evident that, while one preferred embodiment of the posts and the struts has been illustrated and described, various modifications and changes may be made within the spirit and scope of the invention.

I claim as my invention:

1. In a decorative post for a display system, said post being substantially square in cross-section and having a longitudinal groove in each of its sidewalls the improved construction comprising:

four substantially identical elongated pieces of strip material forming four corner sections of said post and each composed of a metal strip, a decorative outer surface on said metal strip, and an outer protective strip overlying and covering said outer surface, said outer protective strip being removably joined to said decorative outer surface;

each of said elongated sections having a central portion constituting two longitudinal side surfaces joined together by a ninety-degree bend, a U-shaped, outwardly opening channel extending along one side of said central portion and having a bottom wall that is offset inwardly from and substantially parallel to the adjacent side surface, and an L-shaped bend extending along the other side of said central portion and having a free edge portion that is offset inwardly from and substantially parallel to the adjacent side surface;

said L-shaped bend on each corner section projecting into the U-shaped channel of the adjacent corner section on one side, and also receiving in its own U-shaped channel the L-shaped bend of the corner section on the other side;

fastening means joining said L-shaped bends to said U-shaped channels to hold said corner sections together;

and means defining a series of slots in said channels each extending through both said free edge portion and said bottom wall for attaching said post to other structural members, said protective strips being removable from said central portions to expose said decorative outer surfaces.

2. A decorative post as defined in claim 1 wherein said metal strip has a non-metallic outer surface.

3. A decorative post as defined in claim 2 wherein said surface is wood-grained vinyl.

4. A decorative post as defined in claim 1 wherein said metal strip is masked with a removable coating forming said protective strip.

5. A decorative post as defined in claim 4 wherein said decorative surface is a polished metal surface.

6. A decorative post as defined in claim 1 further including means weakening each of said protective strips in said channel for neat and easy separation from said post.

7. A decorative post as defined in claim 6 wherein said weakening means are slits in said protective strips.

8. A decorative post as defined in claim 1 wherein said fastening means comprises rivets joining said free edge portions to said bottom walls between adjacent slots of said series.

9. An elongated hollow decorative post for use in a display system, said post having a plurality of substantially flat sidewalls each formed with a longitudinal groove, and comprising:

a plurality of substantially identical elongated pieces of strip material each forming a side section of said post and each defining a corner between two of said substantially flat sidewalls and having a decorative outer surface, an elongated central portion having a transverse bend forming the corner, and said longitudinal groove being defined by groove-forming means along both longitudinal edge portions of the piece of strip material, said groove forming means overlapping and interfitting with the groove-forming means on the adjacent pieces of strip material and cooperating therewith in defining longitudinal grooves along both sides of each of the pieces of strip material;

said groove-forming means of each piece of strip material including inwardly extending groove sidewalls along the opposite sides of the strip that are spaced from the groove sidewalls of adjacent pieces to lie on opposite sides of the groove, and inner walls extending laterally from the inner end of the groove sidewalls and overlapping with the inner walls of adjacent pieces to form the bottom wall of the groove;

fastening means joining said longitudinal edge portions together to hold said pieces of strip material together as said post;

and means defining series of longitudinally spaced slots in said grooves, each slot extending through both of said inner walls for use in attaching other structural members to said post.

10. A decorative post as defined in claim 9 wherein each of said decorative outer surfaces is formed by a layer of decorative material covering each of said elongated pieces and having the same external configuration as the piece.

11. A decorative post as defined in claim 9 further including protective strips overlying and covering said outer decorative surfaces and adhesively and removably secured thereto and having the same external configuration as the pieces of strip material.

12. A decorative post as defined in claim 9 in which said protective strips extend into said grooves and cover the decorative outer surface of each of said overlapping walls, and further including means weakening each of said protective strips in one of said grooves for neat and easy separation from the post of the portions of the strips covering said central portions of the pieces of strip material.

13. A decorative post as defined in claim 9 wherein each of said pieces of strip material is a length of sheet metal having an outer decorative surface of pre-plated metal thereon and covered by a protective strip of covering material adhesively and removably secured to said pre-plated metal, whereby said pieces may be roll-formed from flat material and assembled with the protective strips in place, and the protective strips are removable to uncover the decorative surfaces.

14. A decorative post as defined in claim 13 further including means weakening said protective strips in said grooves for neat and easy separation of the outer portions of the strips from the portions in the grooves.

* * * * *